US005864914A

United States Patent [19]

Salmon

[11] Patent Number: 5,864,914

[45] Date of Patent: Feb. 2, 1999

[54] MOP HOLDER WITH AN ELONGATED FRAME FOR ACCOMMODATING A MOP COVER

[75] Inventor: Dirk Salmon, Wertheim, Germany

[73] Assignee: Vermop Salmon GmbH, Germany

[21] Appl. No.: 695,836

[22] Filed: Aug. 8, 1996

[30] Foreign Application Priority Data

Aug. 8, 1995 [DE] Germany ..... 295 12 724 U

[51] Int. Cl.[6] ..... A47L 13/258

[52] U.S. Cl. ..... 15/147.2; 15/229.4; 15/229.8

[58] Field of Search ..... 15/147.1, 147.2, 15/228, 229.1–229.9

[56] References Cited

U.S. PATENT DOCUMENTS

| | | | |
|---|---|---|---|
| 2,482,163 | 9/1949 | Finnell | 15/118 |
| 3,082,456 | 3/1963 | Short | 15/147.2 |
| 3,383,158 | 5/1968 | Leland | 401/201 |
| 3,711,886 | 1/1973 | Strauss | 15/229.8 |
| 5,165,136 | 11/1992 | Moore | 15/229.4 |

FOREIGN PATENT DOCUMENTS

| | | | |
|---|---|---|---|
| 37 14 178 | 2/1988 | Germany . | |
| 39 23 859 | 2/1990 | Germany . | |
| 93 09 657 | 3/1994 | Germany . | |
| 94 02 509 | 5/1994 | Germany . | |
| 94 15 071 | 12/1994 | Germany . | |
| 44 03 550 | 9/1995 | Germany . | |
| 195 10 824 | 5/1996 | Germany . | |
| 867378 | 9/1991 | U.S.S.R. | 15/147.2 |

*Primary Examiner*—Mark Spisich

*Attorney, Agent, or Firm*—Wolf, Greenfield & Sacks, P.C.

[57] ABSTRACT

The invention relates to a mop holder with an elongated frame (1) for accommodating a mop cover, having at least two e.g. plate-like folding wings (3, 3') forming wiping surfaces for introducing their edge sections (5, 5') in pockets of the mop cover, and having a hinged plate member (4) for attaching a handle holder (7), e.g. by a universal joint. So as to improve such a mop holder to the extent that it combines a high coverage, low chemical and water requirements, a long useful life, short cycle times during the cleaning process and/or simple and convenient operating without stooping and without touching the mop cover, while ensuring a simple design and minimum production costs, the folding wings (3, 3') are hingedly connected together and to hinged plate member (4) around a longitudinal axis (L), and the edge sections (5, 5') provided on the longitudinal edges (8, 8') of folding wings (3, 3') are designed for accommodation in pockets on longitudinal edges of the mop cover.

12 Claims, 9 Drawing Sheets

MOP HOLDER WITH AN ELONGATED FRAME FOR ACCOMMODATING A MOP COVER

Figure 1:
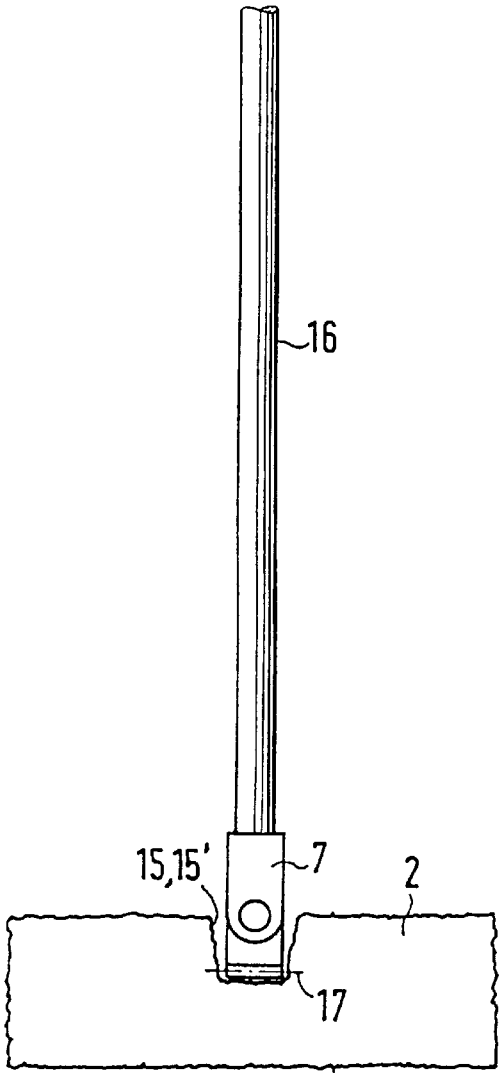

The invention relates to a mop holder with an elongated frame for accommodating a mop cover, having at least two e.g. plate-like folding wings that form wiping surfaces for introducing their edge sections into the mop cover's pockets, and having a hinged plate member for attaching a handle holder, e.g. by means of a universal joint.

Such mop holders are for example known from DE 37 14 178 A1. The two elongated folding wings are pivoted via transverse axes at a central hinged plate member and detachably locked in their extended working position relative thereto. On their underside, they form an essentially continuous wiping surface, while the handle holder connected via a universal joint to the hinged plate member is located on the upper side of the elongated mop holder. A mop cover is mounted in that when the mop holder is folded up, the outer (end-face) ends of the folding wings are introduced into pockets provided on the upper side on the outer (end-face) ends of the elongated mop cover and the folding wings are than converted to their elongated working position, in which they are detachably locked against each other.

The present invention's object is to improve a mop holder comprising the afore-mentioned features in that such a mop holder combines a high coverage, low chemical and water requirements, a long useful life, short cycle times during the cleaning process and/or simple and convenient operating without stooping and without touching the mop cover, while ensuring a simple design and minimum production costs.

By using the invention's mop holder of the initially mentioned type, this object is essentially solved by hingedly connecting the folding wings together and to the hinged plate member around a longitudinal axis and by designing the edge sections provided on the longitudinal edges of the folding wings for accommodation in pockets on the mop cover's longitudinal edges.

The type of hinged connection between the hinged plate member and the two folding wings makes it possible to fold these two folding wings—once they have been introduced, with their lateral edge sections, into the pockets on the mop cover's longitudinal edges—on to the opposing lateral surfaces of the central hinged plate member, and the hinged connection of the handle holder with the hinged plate member makes it possible to align, parallel to the floor to be wiped, the one or other of the folding wings with its outside covered by the mop cover. In this manner, the innovative mop holder has two different wiping surface areas, the one or other of which can be used to clean the floor by correspondingly pivoting or rotating the mop holder. In this manner, the useful life can be doubled or different covering materials can be allocated to the outsides of the two folding wings, e.g. a rougher material for the initial floor treatment, e.g. scouring or scrubbing in order to loosen coarse impurities from the floor, and a softer absorbent material for the floor's after-treatment, e.g. for absorbing dirt and moisture when subsequently wiping and drying the floor. The handle holder's type of hinged connection to the hinged plate member and its hinged connection to the two folding wings also makes it possible to mount the mop holder without the user's hands touching the mop cover and to bring the holder into its working position by reversing the hinged plate member around the longitudinal axis first on to the one folding wing and then, together with the first folding wing, on to the second folding wing, whereby it can be ensured that on account of suitable connecting means, the folding wings remain in their working position relative to the hinged plate member. When it is folded up, this mop holder can also, with the mop cover fitted on, be introduced into a mop press, and during the cleaning process, any excess water can therefore be squeezed out of it and new cleaning fluid absorbed by it.

The hinged connection's geometry is particularly advantageous and the mop holder's structure is particularly simple if according to an embodiment of the invention, the folding wings are hingedly connected together and to the hinged plate member around one and the same longitudinal axis.

A particularly simple handling of the wiping mop is possible when the hinged plate member is pivotable as far as the inside of a folding wing and is detachably connectable thereto, and that the unit composed of the one folding wing and the hinged plate member is then pivotable to the inside of the other folding wing and is detachably connectable thereto so that a relatively flat package of hinged plate member in the middle and the folding wings on the outside is obtained; the mop cover is mounted thereon and it covers their outsides.

Yet it is also possible for the two folding wings to be pivotable upwards from the horizontal line right into a working position and for these wings to be lockable in relation to one another in this position, in which the two folding wings are at an acute angle to each other and enclose the hinged plate member between them. In this instance, the two folding wings' wiping surfaces covered by the mop cover are therefore at an angle to each other.

The mop cover can then be fitted on to the holder in a particularly simple manner if the two folding wings are downwardly pivotable out of the horizontal line away from the hinged plate member right into an insertion position determined for example by a stop; in this position, the downwardly suspended folding wings are at an acute angle to each other. When the mop holder is lifted up by means of the handle grip, the hinged plate member assumes a vertical position, while the two folding wings are downwardly suspended therefrom at an angle. In this position, the mop holder can be fitted on to the mop cover, which is spread flat on the floor, and pressed downwards so that the folding wings spread into their horizontal position and retract with their outer edge sections into the mop cover's pockets.

The detachable connecting device between the folding wings and the hinged plate member may for example have such a catch, clamping, adhesive or burr connection that by pivoting the hinged plate member relative to the folding wings, these connections are producible without manual handling and they are also easily re-detachable.

In particular, the connecting device can be detached by providing an actuating element for separating the folding wings from their contact on the hinged plate member and/or on a folding wing, by means of which actuating element the catch, clamping, adhesive or frictional forces, as may be exerted by the detachable connecting device, can be overcome.

The handle holder's hinged connection is expediently provided on the hinged plate member's longitudinal edge facing away from the longitudinal axis, thereby guaranteeing a simple design while ensuring excellent operability of the wiping mop.

To achieve optimum distribution of forces, the hinged plate member may be narrower than the two folding wings; in other words, they may e.g. be half the width, with the two folding wings additionally having an edge recess in the area of the handle holder. In this manner, the hinged connection of the handle holder on the hinged plate member is located between the two wiping surfaces formed by the folding wings.

Another proposal is for the hinged plate member and the two folding wings to have roughly the same length so that the folding wings are supported over a large surface area of the hinged plate member, thereby minimizing the tendency for dirt to accumulate on the holder.

So as to offset the mop holder's material thickness, it may be appropriate for the folding wings to be thinner in the area of the edge sections than in the central area adjoining the longitudinal axis.

The invention also refers to a mop cover for use on a mop holder, e.g. such a cover whose elongated frame has at least two folding wings pivotable against each other around a longitudinal axis, particularly on a mop holder of the previously discussed type according to the invention. The novel mop cover is characterized by the fact that pockets provided on the longitudinal edges are provided for introducing the longitudinally sided edge sections of the folding wings. Unlike conventional mop covers, which are tensioned in the longitudinal direction, such a transversely held mop cover has the advantage of lower material expansions, with the result that the mop cover is also assured of a reliable fit on the mop holder during a fairly long period of use.

The mop cover may have longitudinal-edge recesses in the area of the handle holder on the hinged plate member so that it can be used on a mop holder whose handle mount is pivoted at the free edge of a hinged plate member which is narrower than the adjacent folding wings in order to achieve an optimum distribution of forces.

The mop cover according to the invention can also be assembled from two different materials such that the one folding wing's wiping surface is covered on the outside with the one material, and the other folding wing's wiping surface is covered on the outside with the other material if the mop cover is mounted on the mop holder. In this manner, the mop cover can be used, for example, for scouring or scrubbing (using a relatively rough material) and for subsequently wiping or drying (using a relatively soft absorbent material). The one functional range helps to separate coarse dirt from the floor's surface, while the other range helps to absorb dirt and water.

Other aims, features, advantages and possible applications of the invention can be seen from the following description of exemplary embodiments based on the drawing. All those features described and/or illustrated form the invention's subject matter either by themselves or in any suitable combination, which is also true regardless of their composition in the claims or of their back reference.

Figure 2:
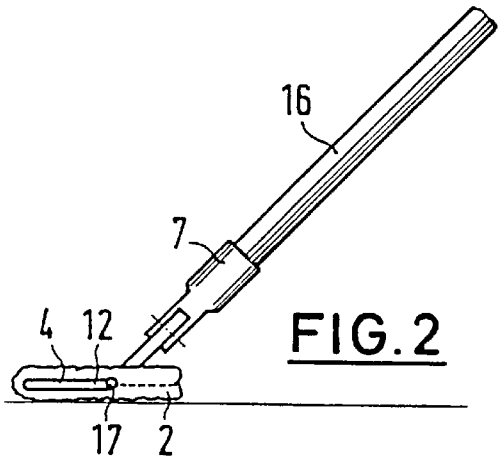
Figure 3A:
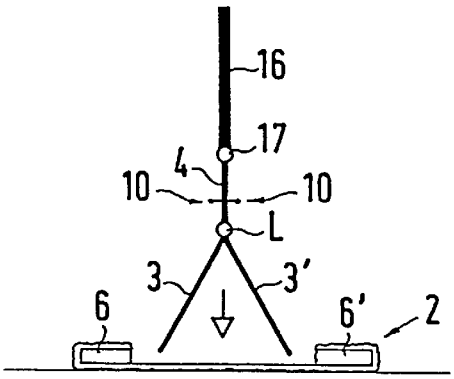
Figure 3B:
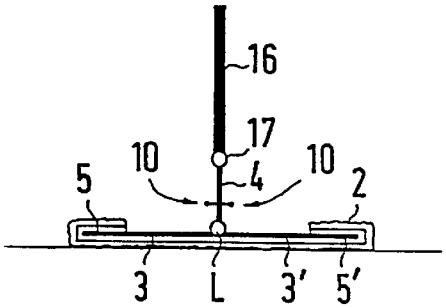
Figure 3C:
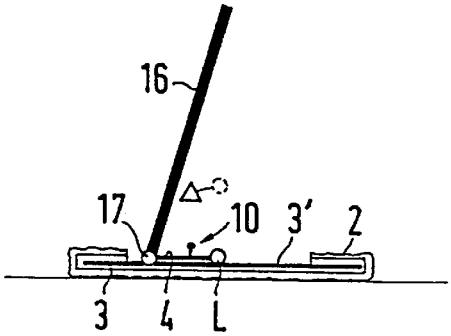
Figure 3D:
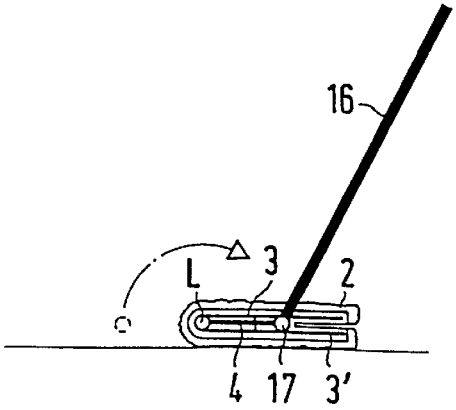
Figure 4:
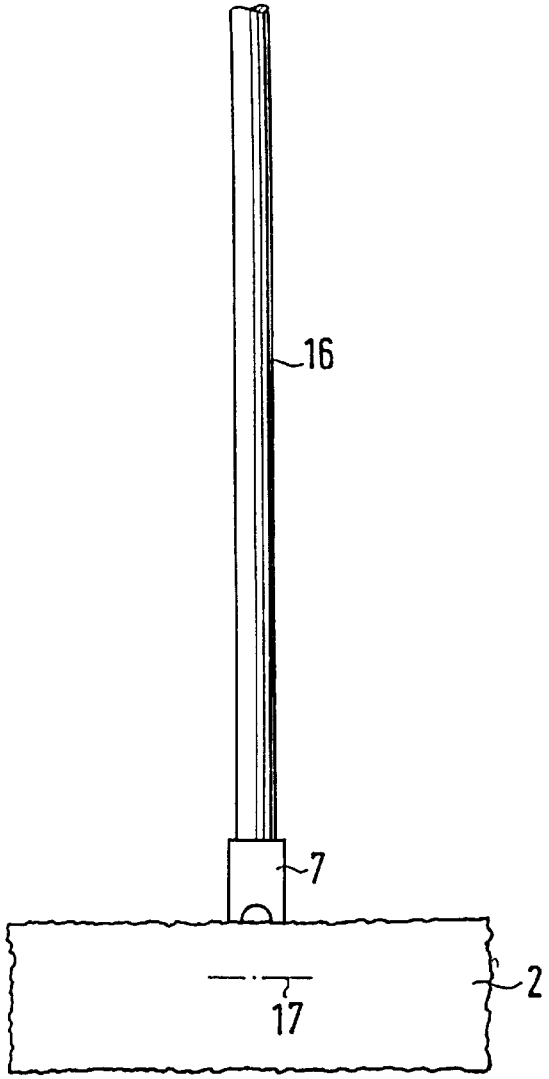
Figure 5:
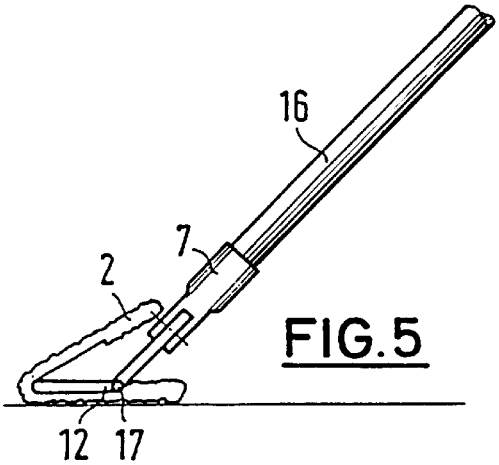
Figure 6A:
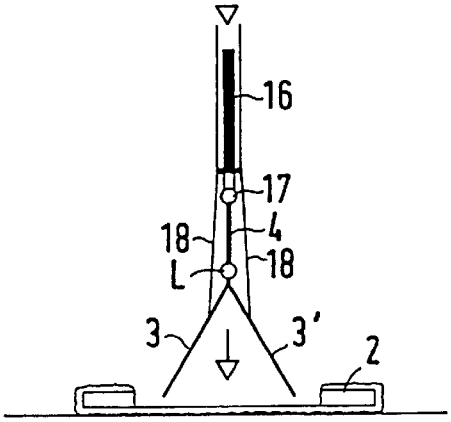
Figure 6B:
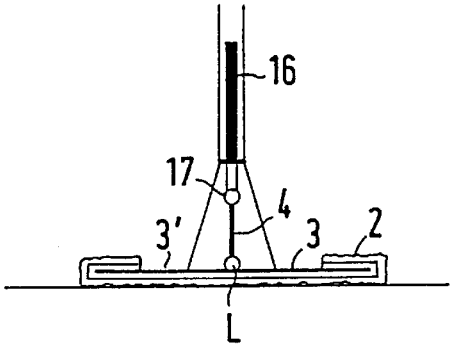
Figure 6C:
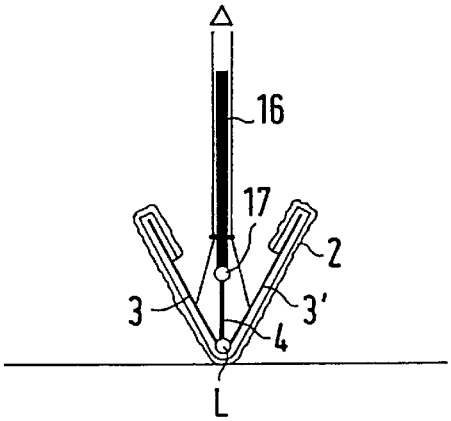
Figure 6D:
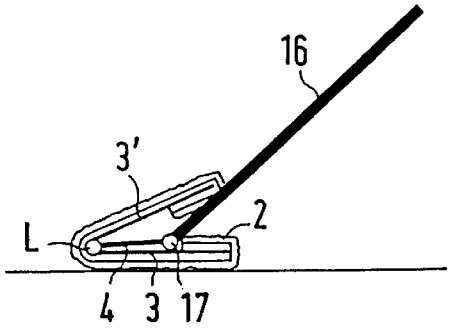
Figure 7:
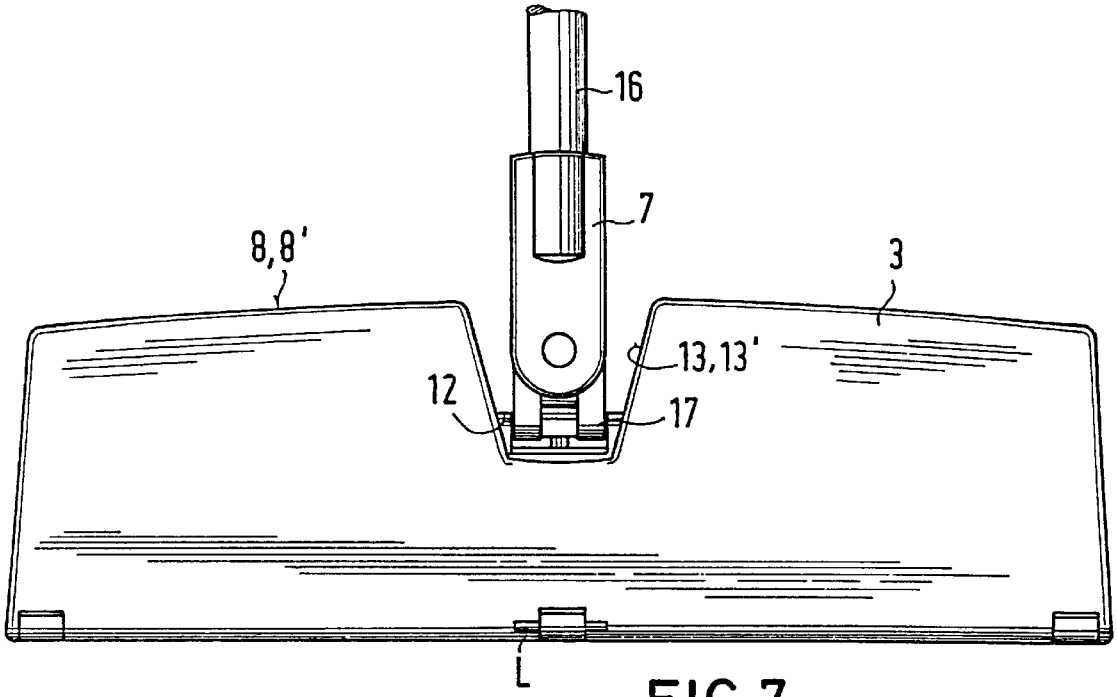
Figure 8:
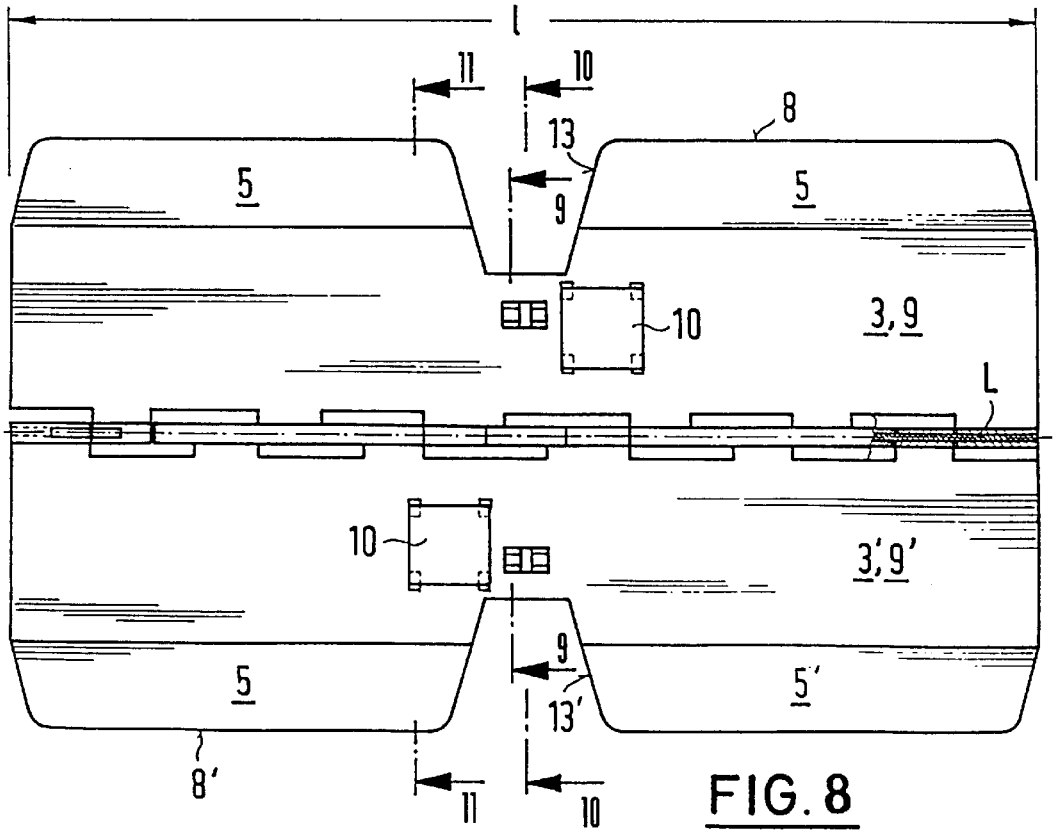
Figure 9:
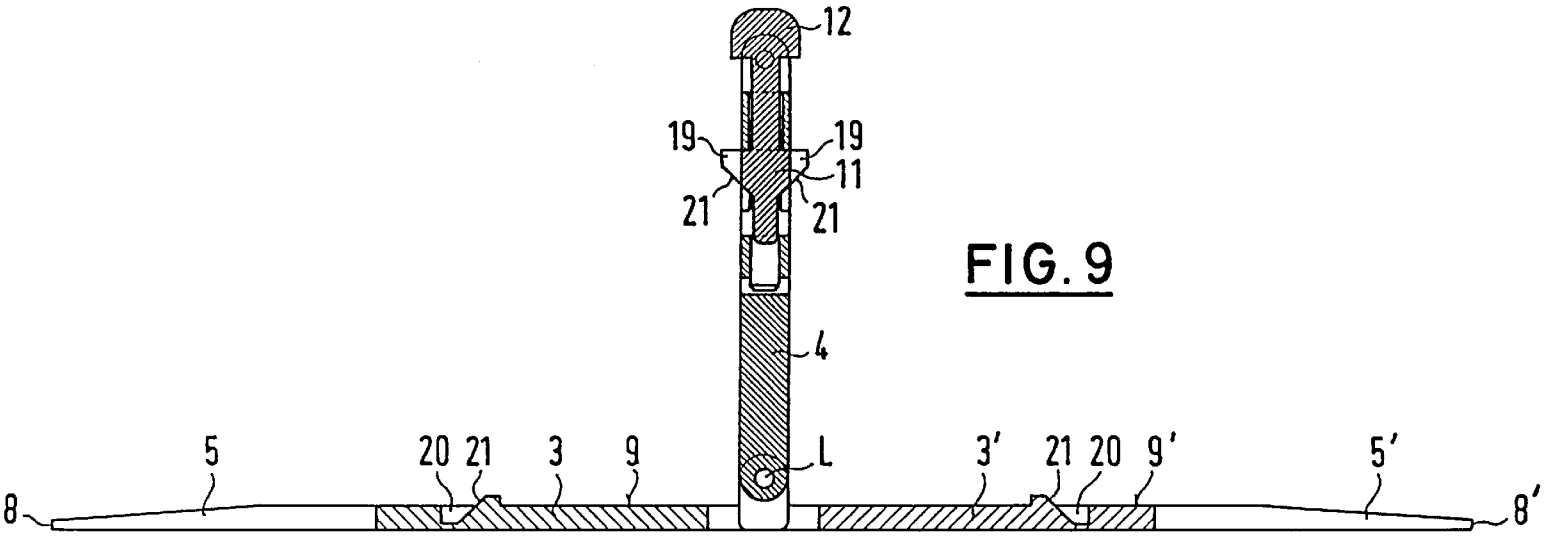
Figure 10:
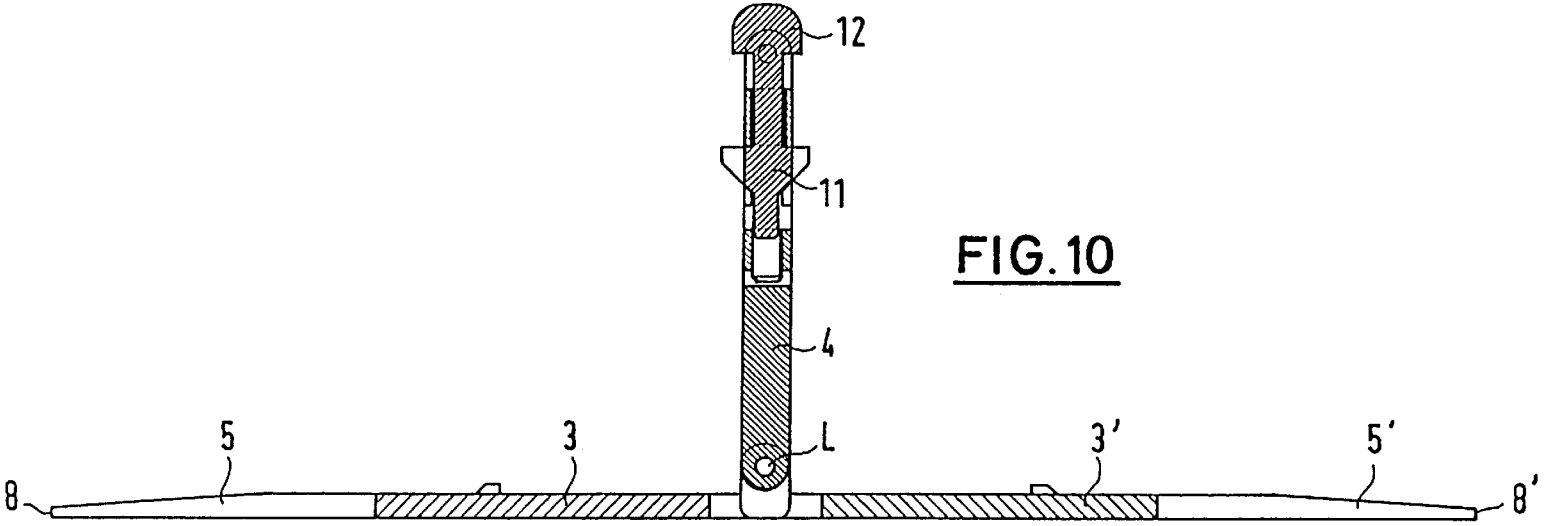
Figure 11:
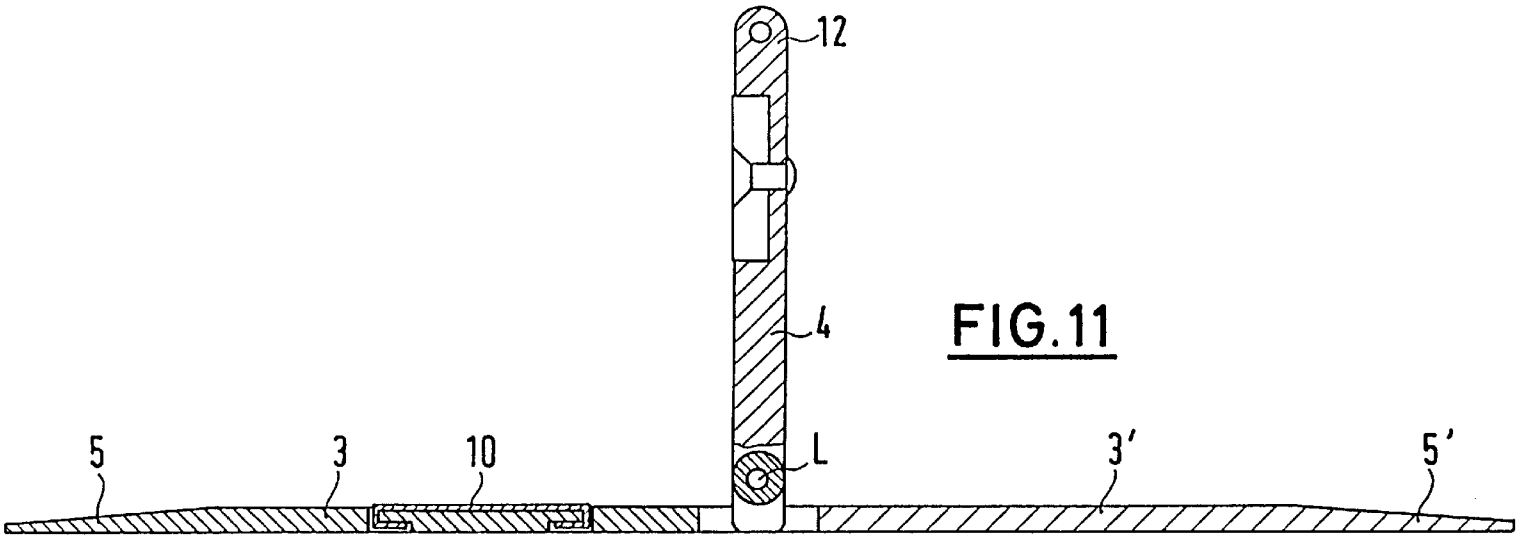
Figure 12:
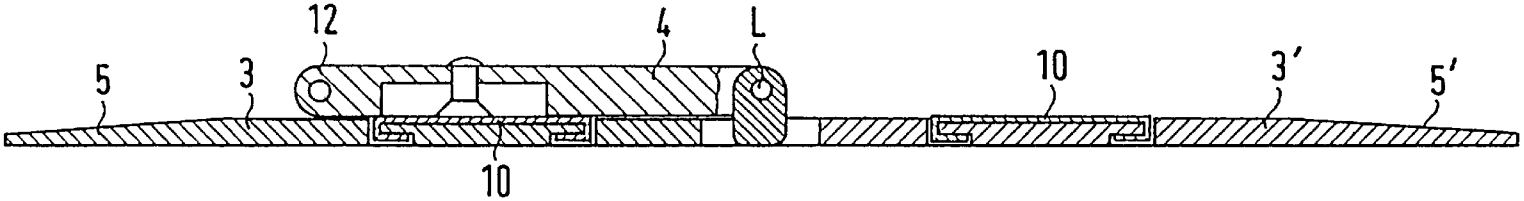
Figure 13:
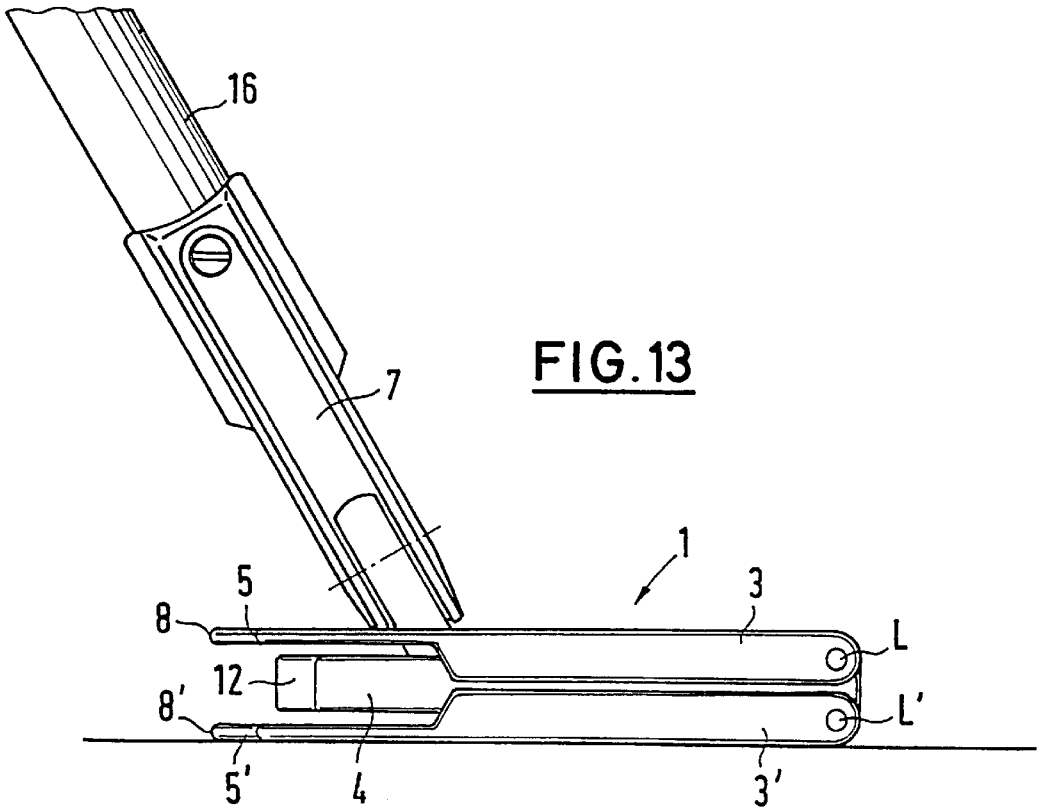
Figure 14:
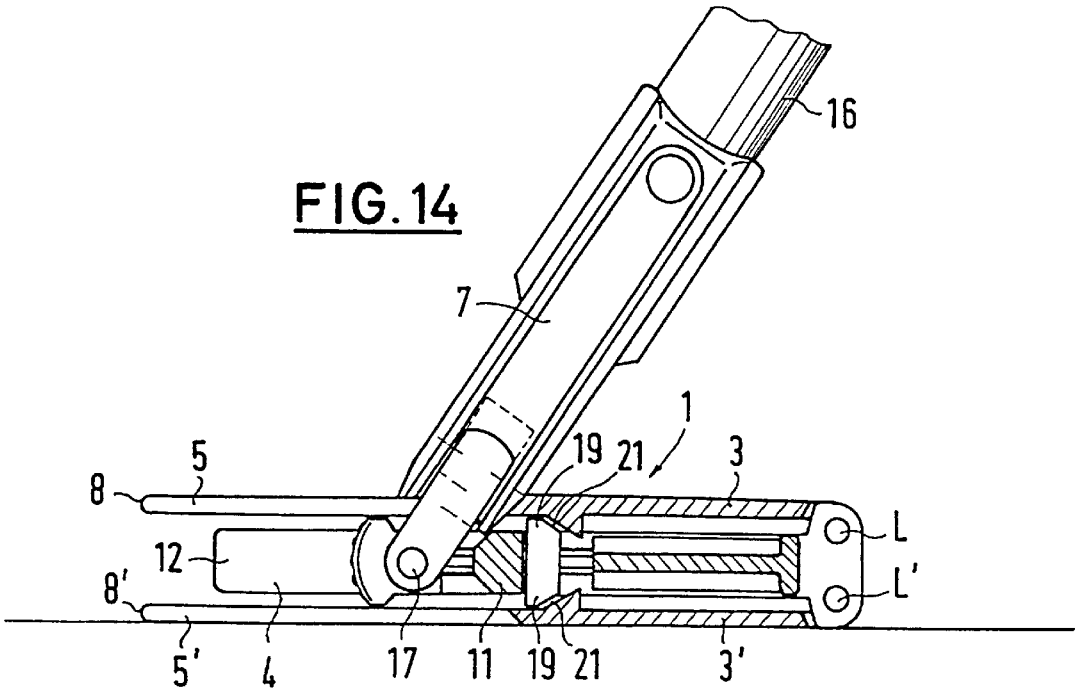
Figure 15:
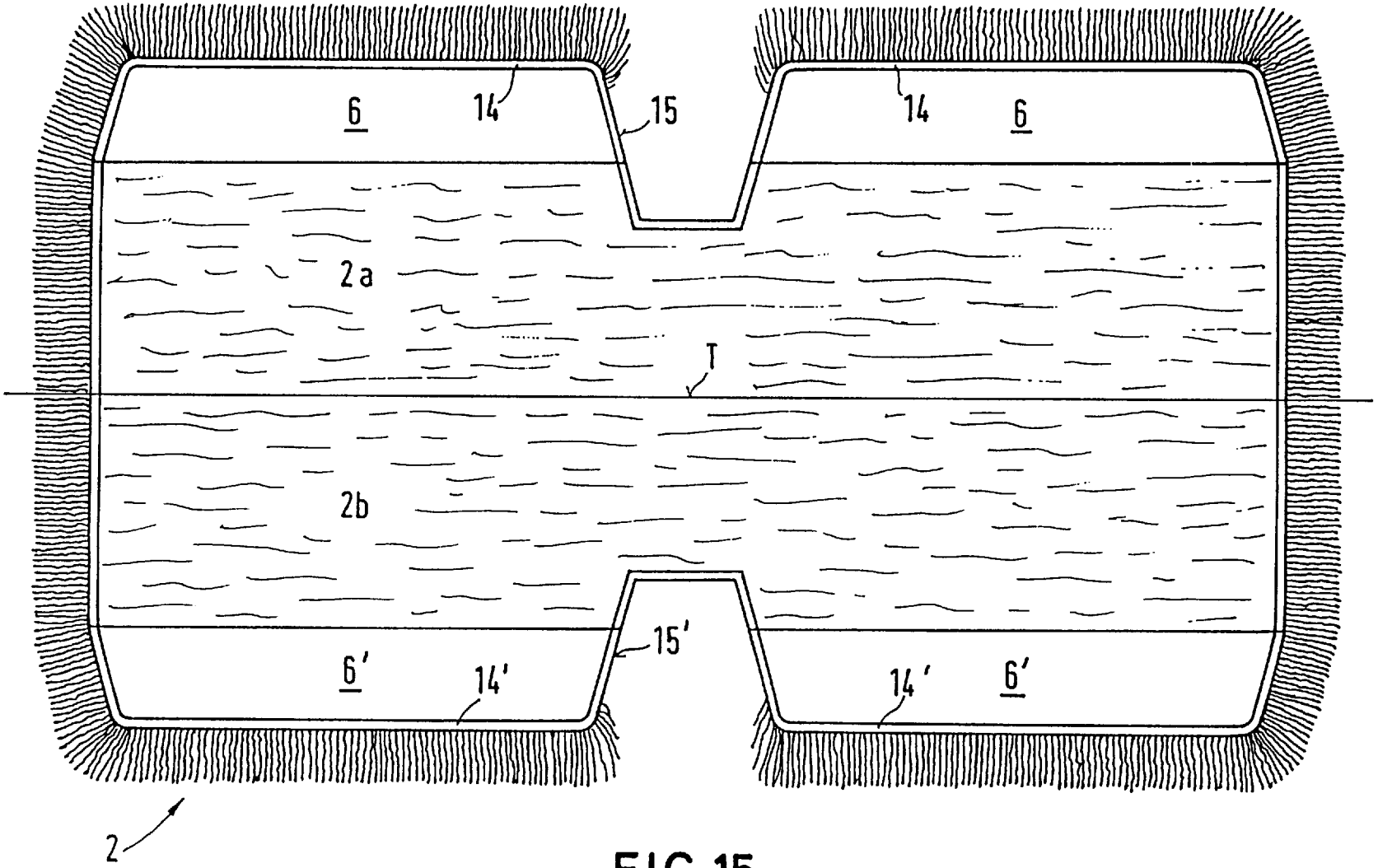

FIG. 1 shows a front view of a mop holder comprising the invention, having a handle holder and handle with the mop cover fitted on, FIG. 2 shows a side view of the mop holder according to FIG. 1, FIGS. 3*a* to 3*d* schematically show the mop holder according to FIG. 1 in various stages of use in order to explain its function, FIG. 4 shows a mop holder according to the invention and corresponding to the representation in FIG. 1 for a different embodiment, FIG. 5 shows a side view of the mop holder according to FIG. 4, FIGS. 6*a* to 6*d* schematically show the mop holder according to FIG. 4 in various stages of use in order to explain its function, FIG. 7 shows the mop holder from FIG. 1 as an enlargement compared thereto and without mop cover, FIG. 8 shows the unfolded mop holder of FIG. 7 seen from below (partially sectioned), FIGS. 9 to 11 show sectional representations corresponding to the lines of intersection 10—10, 9—9 and 11—11 of FIG. 8, FIG. 12 shows a sectional representation corresponding to FIG. 11, although the hinged plate member is reversed on to the one (left-hand) folding wing so as to form a unit therewith by means of adhesive connection; this unit can then be folded on to the other (right-hand) folding wing, FIGS. 13 and 14 show a side view and sectional representation of another embodiment of a mop holder according to the invention, and FIG. 15 shows a horizontal projection of a mop cover according to the invention.

The mop holders shown in the drawings have an elongated frame 1 e.g. of plastic for accommodating a mop cover 2. Each frame 1 has two plate-like folding wings 3, 3' forming wiping surfaces which are to face the floor to be cleaned, and a hinged plate member 4 at whose free longitudinal end 12 a handle holder 7 for a handle 16 is connected by means of a hinged connection 17 e.g. of the universal joint type. At their longitudinal edges 8, 8', the two folding wings 3, 3' have thinner edge sections 5, 5' for accommodation in pockets 6, 6' of said mop cover 2. In the embodiments according to FIGS. 1 to 12, folding wings 3, 3' and hinged plate member 4 are hingedly connected together via one and the same longitudinal axis L.

In the embodiment shown in FIGS. 1 to 3*d*, hinged plate member 4 is pivotable right on to the inside 9 of the one folding wing 3 and detachably connectable thereto, whereupon the unit comprising the one folding wing 3 and hinged plate member 4 is pivotable on to the inside 9' of the other folding wing 3' and is detachably connectable thereto. Detachable connecting means 10 between folding wings 3, 3' and hinged plate member 4 may comprise a catch, clamping, adhesive or burr connection. According to FIGS. 8, 10 and 11, the adhesive connection is formed e.g. by means of a magnet and a metallic counter-plate.

In the embodiments according to FIGS. 4 to 6*d*, both folding wings 3, 3' are upwardly pivotable from the horizontal line right into a working position in which they are lockable in relation to one another. In this working position, both folding wings 3, 3' are at an acute angle to one another and enclose hinged plate member 4 between them. The locking process can take place for example by means of cable pulls 18.

In all the embodiments shown, the two folding wings 3, 3' can pivot out of the horizontal line away from hinged plate member 4, downwards as far as a stop, into an insertion position in which the thus downwardly suspended folding wings 3, 3' are at an acute angle to each other. This represents the preparatory position for introducing folding wings 3, 3' into pockets 6, 6' of mop cover 2.

Although in FIGS. 1 to 3*d* and 5 to 13, folding wings 3, 3' in the flat working position are to be detachably held at central hinged plate member 4, they are also intended to be securely held thereat; there is consequently provision, according to FIGS. 9 and 10, for an actuating element 11, which helps to separate folding wings 3, 3' from their contact on hinged plate member 4. Actuating element 11 has projections 19 which engage into corresponding depressions 20 when hinged plate member 4 is reversed on to corresponding folding wings 3, 3'. When actuating element 11 is for example manually reversed, inclined surfaces 21 of projections 19 and depressions 20 interact in such a way that an outwardly directed separation force is exerted between hinged plate member 4 and the respective folding wing 3, 3', making it possible to overcome the catch, clamping, adhesive or frictional forces produced on account of connecting means 10 or produced in any other manner. In this way, the mop holder can be easily re-opened.

As is particularly apparent from FIGS. 2, 3*a* to 3*d*, 7 and 9 to 12, hinged plate member 4 is much narrower than folding wings 3, 3', for example it is only half as wide. Since hinged connection 17 is attached to the outer (free) longitudinal edge 12 so that the compressive forces can be applied roughly in the middle of the wiping surfaces, but since it should also be ensured that in its working position according to FIG. 3*d*, the mop holder is to be pivotable from the one side to the other so that the two different wiping surfaces can be used, both folding wings 3, 3' comprise, according to FIGS. 7 and 8, outer edge recesses 13, 13'.

According to FIG. 15, mop cover 2 with its longitudinally sided pockets 6, 6' therefore also has corresponding recesses 15, 15' on its longitudinal edges 14, 14'.

The embodiment of a mop holder shown in FIGS. 13 and 14 is characterized in that folding wings 3, 3' are pivoted around parallel longitudinal axes L, L' on the inner edge of hinged plate member 4.

FIGS. 3*a* and 3*d* illustrate the mode of operation based on the invention's mop holder according to FIGS. 1 and 2. The mop is taken hold of at handle 16 and held such that the mop holder is at a minimum distance above mop cover 2 placed flat on the floor. On account of the hinged connections, hinged plate member 4 is suspended vertically downward and the two folding wings 3, 3' are located in their downwardly suspended, slightly spread position (FIG. 3*a*). The mop is then lowered to the floor so that both folding wings 3, 3' with their outer edge sections 5, 5' can dip into pockets 6, 6' at the correspondingly aligned longitudinal edges 14, 14' of mop cover 2 (FIG. 3*b*). Hinged plate member 4 is then reversed by means of handle 16 toward the one side around longitudinal axis L on to folding wing 3 where a connection by means of connecting device 10 between hinged plate member 4 and folding wing 3 is produced either manually or automatically (FIG. 3*c*). The unit comprising folding wing 3 and hinged plate member 4 can then be pivoted via longitudinal axis L toward the other side on to the other folding wing 3'. The connection between hinged plate member 4 and folding wing 3' is also produced there by means of connecting device 10 either automatically or manually. The mop holder then assumes the working position shown in FIG. 3*d*, with two wiping surfaces being available since the unit comprising the two folding wings 3, 3' and hinged plate member 4 with mop head 2 can be pivoted around hinged connection 17 by utilizing recesses 13, 13' and 15, 15'.

A similar procedure is arrived at from FIGS. 6*a* to 6*d* for a mop holder according to FIGS. 4 and 5. The two folding wings 3, 3' are not however completely folded on to hinged plate member 4 and connected thereto, but are locked for example by means of cable pulls 18 in a working position in which folding wings 3, 3' are at an acute angle to one another and enclose hinged plate member 4 between them. Since the unit comprising hinged plate member 4 and the two folding wings 3, 3' with the drawn-up mop cover 2 remains pivotable around hinged connection 17, two wiping surfaces, which are at said acute angle to each other, are also available here.

Mop cover 2 as shown in FIG. 15 comprises two material sections 2*a*, 2*b* with differing material properties, i.e. different functional ranges, with the result that the floor can first be scoured or scrubbed using a relatively rough material and then cleaned or dried using a relatively soft material.

List of reference numerals:

1 Frame
2 Mop cover
2*a*, 2*b* Material sections
3, 3' Folding wings
4 Hinged plate member
5, 5' Edge sections
6, 6' Pockets
7 Handle holder
8, 8' Longitudinal edges
9, 9' Inside
10 Connecting means
11 Actuating element
12 Longitudinal edge
13, 13' Edge recess
14, 14' Longitudinal edges
15, 15' Recesses
16 Handle
17 Hinged connection
L, L' Longitudinal axes
l Length
T Longitudinal separation line

I claim:

1. A mop holder with an elongated frame (1) for accommodating a mop cover (2), having at least two plate-like folding wings (3, 3') including edge sections (5, 5') on longitudinal edges (8, 8') thereof, said folding wings (3, 3') forming wiping surfaces for introducing said edge sections (5, 5') into pockets (6, 6') of said mop cover (2), and having a handle holder (7) and a hinged plate member (4) for attaching said handle holder (7), characterized in that said folding wings (3, 3') are hingedly connected together and to said hinged plate member (4) around a longitudinal axis (L) and that said edge sections (5, 5') provided on the longitudinal edges (8, 8') of said folding wings (3, 3') are designed for accommodation in the pockets (6, 6') on longitudinal edges (14, 14') of said mop cover (2), and further characterized in that said hinged plate member (4) is pivotable on to an inside (9) of one of said folding wings (3) and is detachably connectable thereto, and that an assembly comprising said one of said folding wings (3) and said hinged plate member (4) is then pivotable on to an inside (9') of the other of said folding wings (3') and is detachably connectable thereto.

2. A mop holder according to claim 1, characterized in that said two folding wings (3, 3') are upwardly pivotable from a horizontal line into a working position and are lockable in relation to each other in said working position in which said two folding wings (3, 3') are at an acute angle to each other and enclose said hinged plate member (4) between them.

3. A mop holder according to claim 1, characterized in that said two folding wings (3, 3') are downwardly pivotable away from said hinged plate member (4) out of a horizontal line into an insertion position in which said folding wings (3, 3') are at an acute angle to each other.

4. A mop holder according to claim 1, further comprising detachable connecting means (10) between said folding wings (3, 3') and said hinged plate member (4), said detachable connecting means (10) having a connection selected from the group consisting of a catch, a clamping connection, an adhesive connection and a burr connection.

5. A mop holder according to claim 1, characterized by an actuating element (11) for separating said folding wings (3, 3') from their contact on said hinged plate member (4).

6. A mop holder according to claim 1, characterized in that a hinged connection (17) to said handle holder (7) is provided on a longitudinal edge (12), spaced from said longitudinal axis (L), of said hinged plate member (4).

7. A mop holder according to claim 1, characterized in that said hinged plate member (4) is narrower than said two folding wings (3, 3').

8. A mop holder according to claim 1, characterized in that said two folding wings (3, 3') have an edge recess (13, 13') adjacent to said handle holder (7).

9. A mop holder according to claim 1, characterized in that said hinged plate member (4) and said two folding wings (3, 3') have approximately the same length (l).

10. A mop holder according to claim 1, characterized in that said folding wings (3, 3') are thinner in an area of said edge sections (5, 5') than in a central area adjoining said longitudinal axis (L).

11. A mop cover for use on a mop holder including an elongated frame (1) having at least two folding wings (3, 3') pivotable against each other around a longitudinal axis (L), said folding wings (3, 3') having edge sections (5, 5') on longitudinal edges (8, 8') thereof, said mop cover having longitudinal edges (14, 14'), characterized by pockets (6, 6') provided on said longitudinal edges (14, 14') for introducing the edge sections (5, 5') of said folding wings (3, 3') and, when said mop cover is mounted on said mop holder, being characterized by recesses (15, 15') of said longitudinal edges (14 14') adjacent to a handle holder (7) on said mop holder.

12. A mop cover according to claim 11, characterized by two material sections **(2*a*, 2*b*)** with different properties which can be optionally brought into contact with a surface to be cleaned, with a longitudinal separation line (T).

* * * * *